US011753969B2

(12) United States Patent
Figueiredo et al.

(10) Patent No.: US 11,753,969 B2
(45) Date of Patent: Sep. 12, 2023

(54) RECIRCULATING HYDRAULIC FLUID CONTROL VALVE

(71) Applicant: Schaeffler Technologies AG & Co. KG, Herzogenaurach (DE)

(72) Inventors: Gustavo de Oliveira Figueiredo, Sterling Heights, MI (US); Andrew Mlinaric, Lakeshore (CA)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 171 days.

(21) Appl. No.: 17/140,172

(22) Filed: Jan. 4, 2021

(65) Prior Publication Data

US 2021/0215070 A1 Jul. 15, 2021

Related U.S. Application Data

(60) Provisional application No. 62/958,747, filed on Jan. 9, 2020.

(51) Int. Cl.

| | |
|---|---|
| ***F01L 1/344*** | (2006.01) |
| ***F01L 1/047*** | (2006.01) |
| ***F15B 13/02*** | (2006.01) |

(52) U.S. Cl.

CPC ..... *F01L 1/3442* (2013.01); *F01L 1/047* (2013.01); *F15B 13/021* (2013.01); *F01L 2001/3443* (2013.01); *F01L 2001/34423* (2013.01); *F01L 2001/34426* (2013.01); *F01L 2001/34433* (2013.01)

(58) Field of Classification Search

CPC ..... F01L 1/3442; F01L 2001/34423; F01L 2001/34426; F01L 2001/34433; F01L 2001/3443; F01L 1/047; F15B 13/021; F15B 13/0402

See application file for complete search history.

(56) References Cited

U.S. PATENT DOCUMENTS

| | | | | |
|---|---|---|---|---|
| 8,225,818 | B1 * | 7/2012 | Stephens | F16K 11/0716 137/625.68 |
| 2013/0206088 | A1 | 8/2013 | Wigsten | |
| 2015/0218977 | A1 | 8/2015 | Hofmann et al. | |
| 2015/0300213 | A1 | 10/2015 | Kaufmann et al. | |
| 2017/0058726 | A1 | 3/2017 | Smith et al. | |
| 2018/0016950 | A1 | 1/2018 | Haltiner, Jr. | |
| 2018/0266283 | A1 | 9/2018 | Smith et al. | |
| 2018/0363514 | A1 | 12/2018 | Stanhope | |
| 2019/0107014 | A1 | 4/2019 | Smith | |
| 2019/0234244 | A1 * | 8/2019 | Hisaeda | F01L 1/022 |

(Continued)

FOREIGN PATENT DOCUMENTS

| | | | |
|---|---|---|---|
| CN | 110318836 | A | 10/2019 |
| CN | 110359976 | A | 10/2019 |
| CN | 110360347 | A | 10/2019 |

(Continued)

*Primary Examiner* — Loren C Edwards

(57) ABSTRACT

A hydraulic fluid control valve (HFCV) configured to recirculate an exiting hydraulic fluid from a first hydraulic actuation chamber to a second hydraulic actuation chamber is provided. The HFCV includes a selectively movable spool having an inner fluid chamber configured to receive and deliver the exiting hydraulic fluid to one or both of either a sump or one of the first or second hydraulic actuation chambers.

12 Claims, 6 Drawing Sheets

(56) References Cited

U.S. PATENT DOCUMENTS

| | | | | |
|---|---|---|---|---|
| 2019/0323389 | A1* | 10/2019 | Mitsutani | F15B 15/12 |
| 2021/0215070 | A1 | 7/2021 | Figueirdo et al. | |

FOREIGN PATENT DOCUMENTS

| | | | |
|---|---|---|---|
| DE | 102016118962 | A1 | 4/2018 |
| JP | 2006090307 | A | 4/2006 |
| WO | 2020152965 | A1 | 7/2020 |

* cited by examiner

RECIRCULATING HYDRAULIC FLUID CONTROL VALVE

CROSS-REFERENCE TO RELATED APPLICATIONS

This application claims the benefit under 35 U.S.C. § 119(e) of U.S. Provisional Application No. 62/958,747 filed on Jan. 9, 2020, which application is incorporated herein by reference.

TECHNICAL FIELD

This disclosure is generally related to a hydraulic fluid control valve that can be applied to a hydraulically actuated component or system, including, but not limited to, a camshaft phaser for an internal combustion (IC) engine.

BACKGROUND

A hydraulic fluid control valve can manage delivery of pressurized hydraulic fluid to a hydraulically actuated component such as a camshaft phaser of an internal combustion engine. Pressurized hydraulic fluid in an internal combustion engine is provided by a hydraulic fluid pump that is fluidly connected to a reservoir or sump of hydraulic fluid. The size, and, thus, power requirement of the hydraulic fluid pump is dependent upon a total volume of pressurized fluid that is requested or consumed by the internal combustion engine and its associated hydraulic fluid systems. This requested or consumed hydraulic fluid can be reduced by recirculating and re-using at least some of the hydraulic fluid that is typically returned to the reservoir or sump after being utilized for actuation purposes within a hydraulically actuated component.

SUMMARY

An example embodiment of a hydraulic fluid control valve is provided that includes a housing and a spool. The housing has a first fluid port configured to be fluidly connected to a first hydraulic actuation chamber and a second fluid port configured to be fluidly connected to a second hydraulic actuation chamber. The first and second hydraulic actuation chambers are configured to receive and exit hydraulic fluid. The spool is disposed at least partially within the longitudinal housing. The spool has a vent aperture, a first aperture, a second aperture, and a third aperture. The first aperture can be arranged at a spring end of the spool, the vent aperture can be arranged at an actuation end of the spool, and the second and third apertures are arranged between the first aperture and the vent aperture. In a first axial position of the spool: the first aperture is configured to receive hydraulic fluid from the first hydraulic actuation chamber; the second aperture is configured to deliver a portion of the hydraulic fluid from the first hydraulic actuation chamber to the second hydraulic actuation chamber; and, the vent aperture is configured to exit a second portion of the hydraulic fluid from the first hydraulic actuation chamber. In a second axial position of the spool: the third aperture is configured to receive hydraulic fluid from the second hydraulic actuation chamber; the second aperture is configured to deliver a first portion of the hydraulic fluid from the second hydraulic actuation chamber to the first hydraulic actuation chamber; and, the vent aperture is configured to exit a second portion of the hydraulic fluid from the second hydraulic actuation chamber.

The spool can have a longitudinally extending inner fluid chamber configured to directly contact hydraulic fluid and continuously fluidly connect any one of the four apertures to a remaining three of the apertures in the first and second axial positions of the spool.

A one-way valve can be arranged between a radial outer surface of the spool and a radial inner surface of the housing. The one-way valve can open in a radial direction. The one-way valve can be configured to allow: the hydraulic fluid from the first actuation chamber to flow from the second aperture to the second hydraulic actuation chamber in the first axial position of the spool; and, the hydraulic fluid from the second hydraulic actuation chamber to flow from the second aperture to the first hydraulic actuation chamber in the second axial position of the spool.

In an example embodiment, the inner fluid chamber can be configured to: receive hydraulic fluid from the first hydraulic actuation chamber and deliver a first portion of the hydraulic fluid from the first hydraulic actuation chamber to the second hydraulic actuation chamber; and, receive hydraulic fluid from the second hydraulic actuation chamber and distribute a first portion of the hydraulic fluid from the actuation chamber to the first hydraulic actuation chamber. The second aperture (also referred to as the recirculation aperture) can be configured to deliver: the first portion of the hydraulic fluid from the first hydraulic actuation chamber to the second hydraulic actuation chamber; and the first portion of the hydraulic fluid from the second hydraulic actuation chamber to the first hydraulic actuation chamber.

An example embodiment of a camshaft phaser is provided that includes a rotor, a stator, and a hydraulic fluid control valve. The rotor is configured to be drivably connected to a camshaft, the stator is configured to be drivably connected to the crankshaft, and the stator and rotor form first and second hydraulic actuation chambers. The hydraulic control valve is configured to control a rotational position of the rotor relative to the stator via pressurization and de-pressurization of the first and second hydraulic actuation chambers. The hydraulic control valve includes a spool configured to receive hydraulic fluid at a first end of the inner fluid chamber from the first hydraulic actuation chamber. The spool defines an inner fluid chamber that is configured to: receive hydraulic fluid at a first end of the inner fluid chamber from the first hydraulic actuation chamber; provide a first fluid path for the hydraulic fluid from the first hydraulic actuation chamber, the first fluid path extending from the first end towards a second end of the inner fluid chamber, defining a first fluid flow direction; provide a second fluid path for a first portion of the hydraulic fluid from the first hydraulic actuation chamber, the second fluid path extending from the first fluid path; receive hydraulic fluid from the second hydraulic actuation chamber; provide a third fluid path in the first fluid flow direction for a first portion of the hydraulic fluid from the second hydraulic actuation chamber; and, provide a fourth fluid path in a second fluid flow direction, opposite the first fluid direction, for a second portion of the hydraulic fluid from the second hydraulic actuation chamber. In a further aspect, the inner fluid chamber can have a recirculation aperture arranged at a medial position on the spool, the recirculation aperture configured to exit both the first portion of the hydraulic fluid from the first hydraulic actuation chamber and the second portion of the hydraulic fluid from the second hydraulic actuation chamber. In yet a further aspect, the inner fluid chamber can have a vent aperture configured to exit: i) a second portion of the hydraulic fluid from the first hydraulic actuation chamber to a sump; and, ii) the first portion of the hydraulic fluid from the second hydraulic actuation chamber to the sump.

BRIEF DESCRIPTION OF THE DRAWINGS

The above mentioned and other features and advantages of the embodiments described herein, and the manner of attaining them, will become apparent and better understood by reference to the following descriptions of multiple example embodiments in conjunction with the accompanying drawings. A brief description of the drawings now follows.

DETAILED DESCRIPTION OF THE EMBODIMENTS

Figure 1:
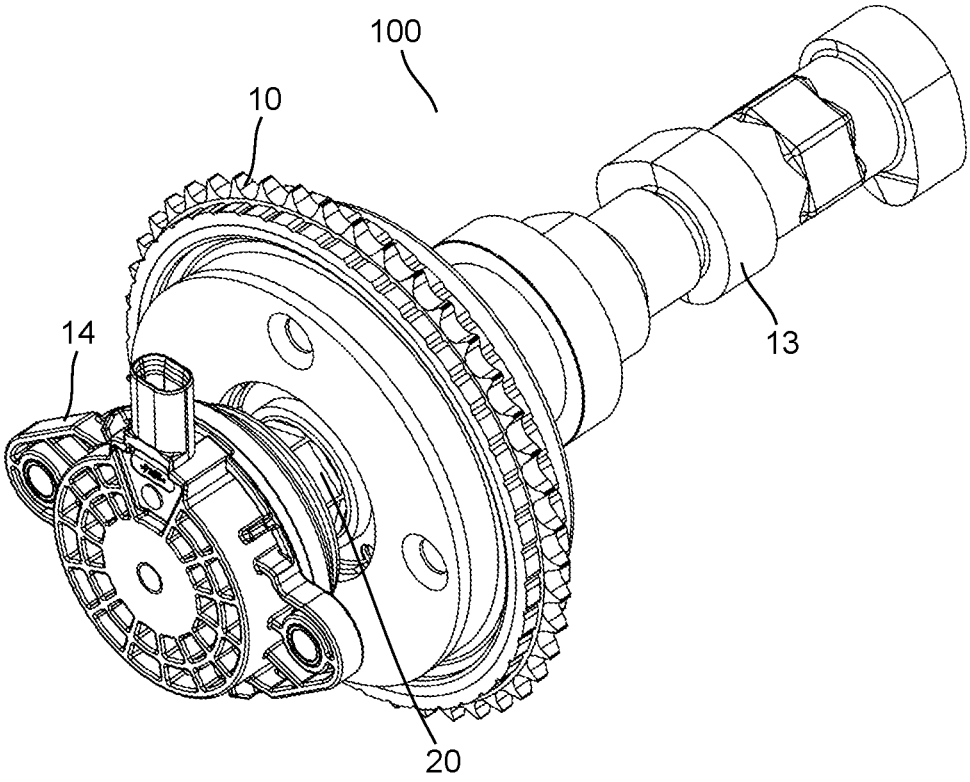
FIG. 1 is a perspective view of camshaft phaser system that includes an actuator, an example embodiment of a hydraulic fluid control valve (HFCV), a camshaft phaser, and a camshaft.

Identically labeled elements appearing in different figures refer to the same elements but may not be referenced in the description for all figures. The exemplification set out herein illustrates at least one embodiment, in at least one form, and such exemplification is not to be construed as limiting the scope of the claims in any manner. Certain terminology is used in the following description for convenience only and is not limiting. The words "inner," "outer," "inwardly," and "outwardly" refer to directions towards and away from the parts referenced in the drawings. Axially refers to directions along a diametric central axis or a rotational axis. Radially refers to directions that are perpendicular to the central axis. The words "left", "right", "up", "upward", "down", and "downward" designate directions in the drawings to which reference is made. The terminology includes the words specifically noted above, derivatives thereof, and words of similar import.

Figure 2:
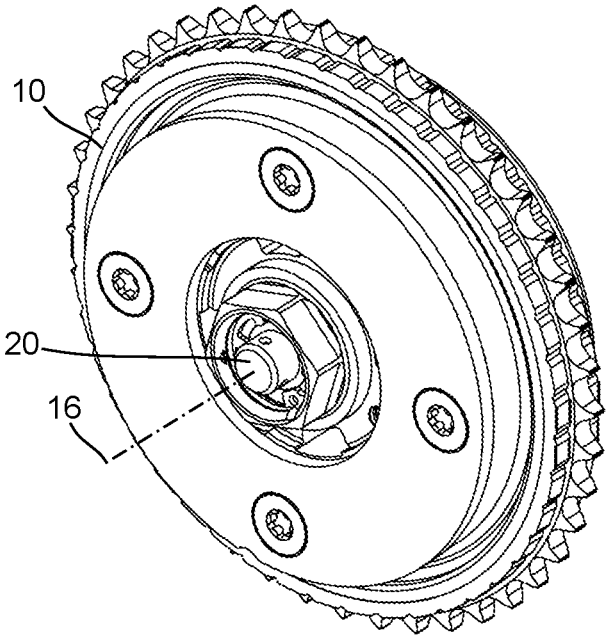
FIG. 2 is a perspective view of the camshaft phaser and HFCV of FIG. 1.
Figure 3:
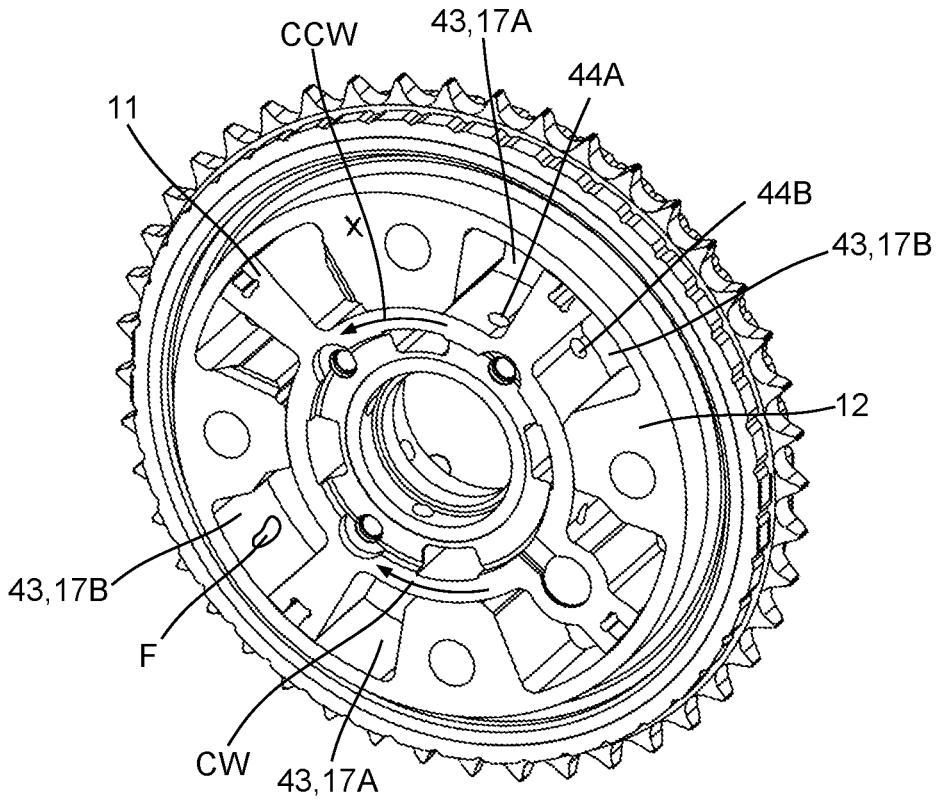
FIG. 3 is a perspective view of a rotor and a stator of the camshaft phaser of FIG. 1.
Figure 4:
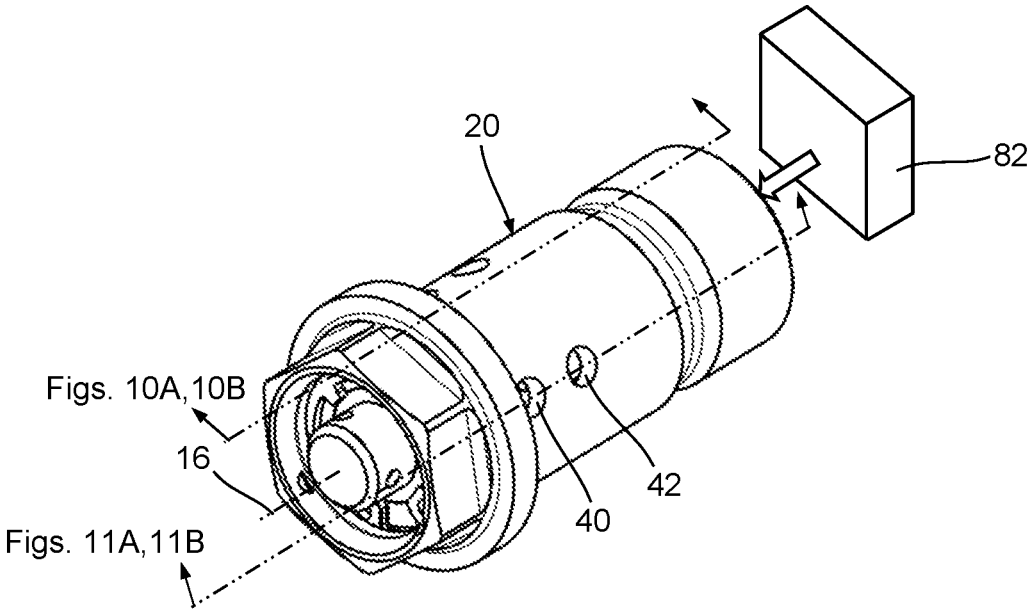
FIG. 4 is a perspective view of the HFCV of FIG. 1 together with a hydraulic fluid pressure source.
Figure 5:
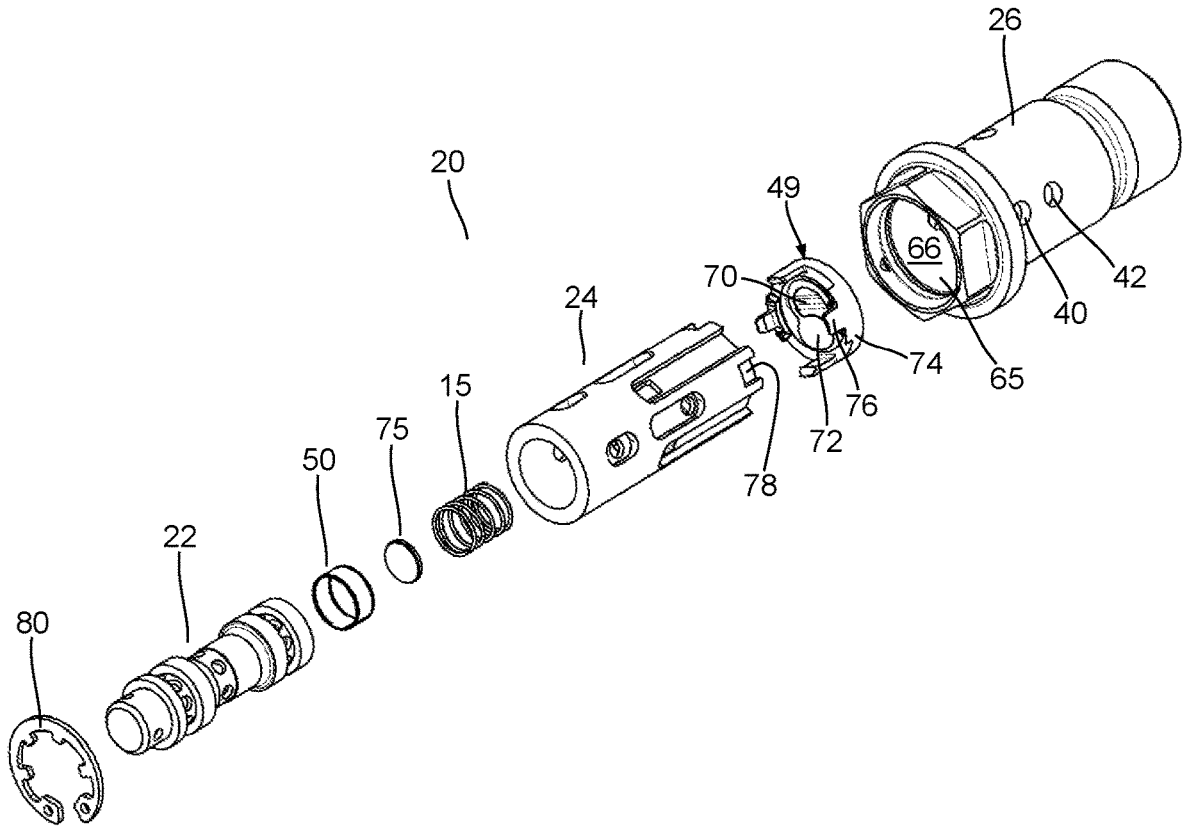
FIG. 5 is an exploded perspective view of the HFCV of FIG. 4 including a spool, a one-way valve, a hydraulic sleeve, and an outer housing.
Figure 6:
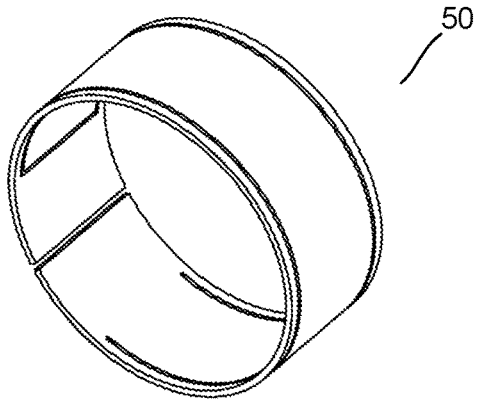
FIG. 6 is a perspective view of the one-way valve of FIG. 5.
Figure 7:
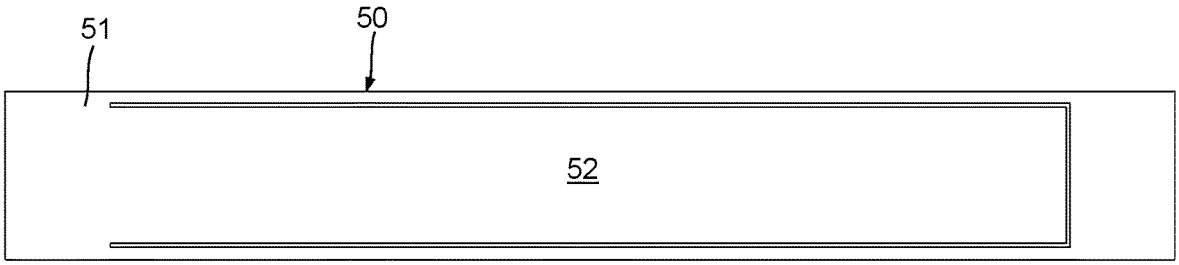
FIG. 7 is a development view of the one-way valve of FIG. 6.
Figure 8A:
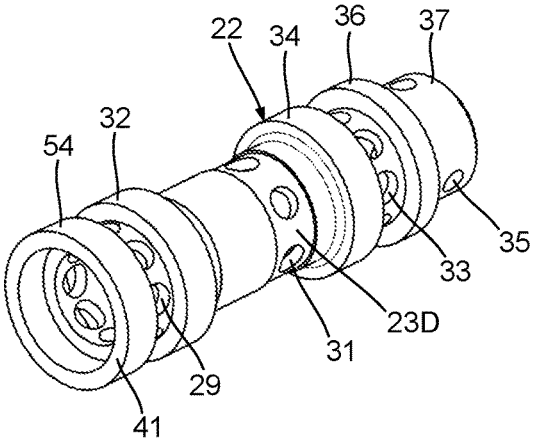
FIG. 8A is a perspective view of the spool of FIG. 5 without the one-way valve installed.
Figure 8B:
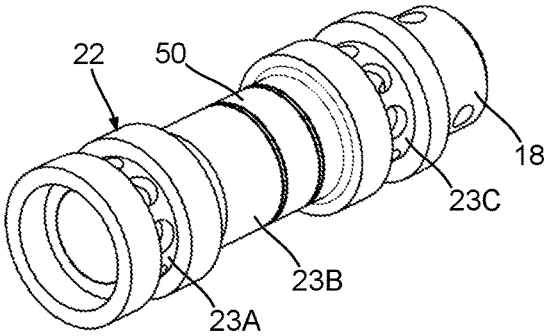
FIG. 8B is a perspective view of the spool of FIG. 5 with the one-way valve installed.
Figure 9A:
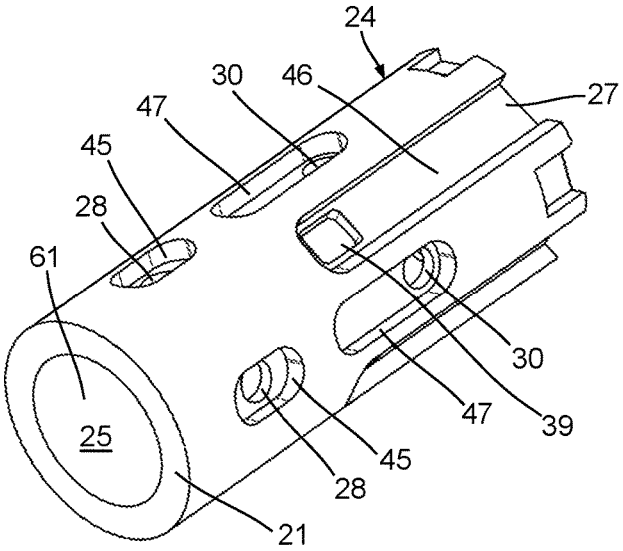
FIG. 9A is a perspective view of the hydraulic sleeve of FIG. 5.
Figure 9B:
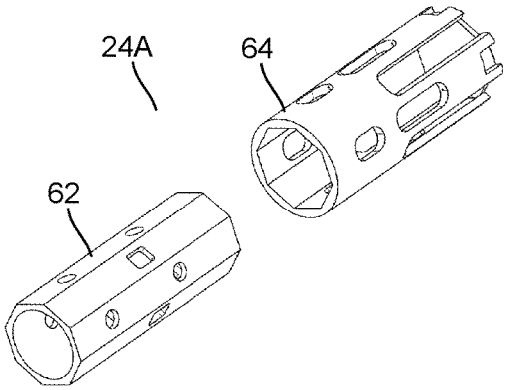
FIG. 9B is an exploded perspective view of an example embodiment of a hydraulic sleeve.
Figure 10A:
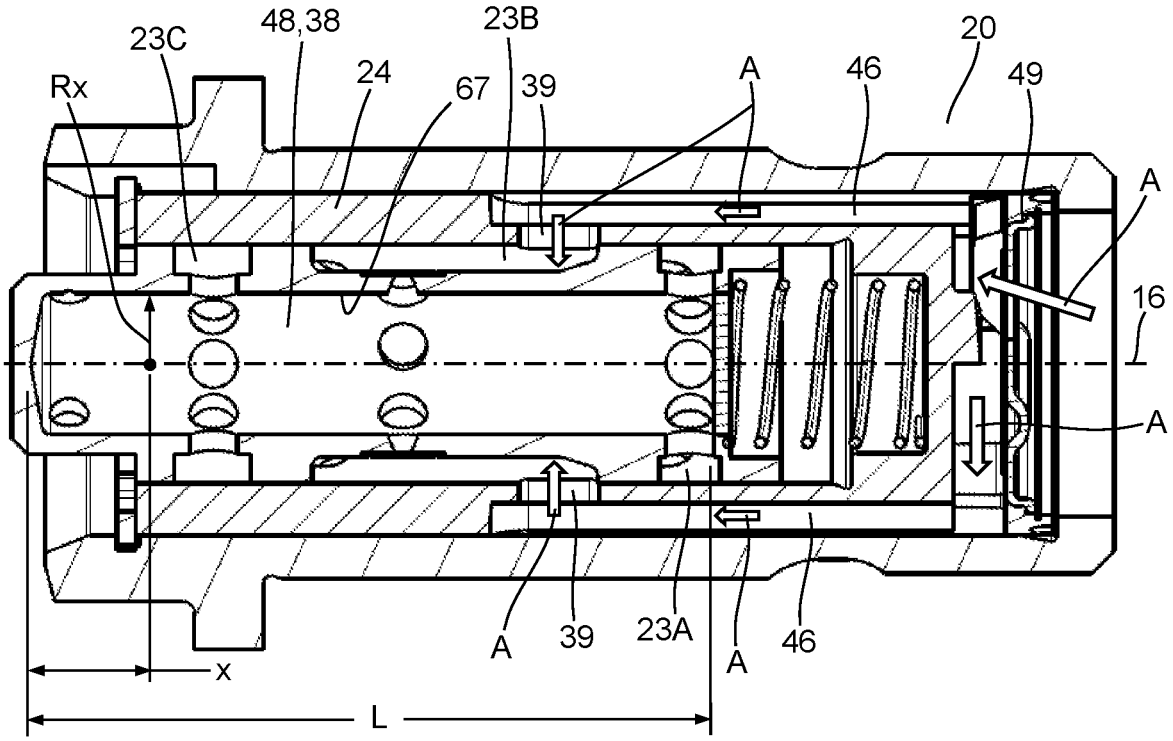
FIG. 10A is a cross-sectional view taken from FIG. 4 showing an inlet hydraulic fluid path in a de-energized state of the HFCV.
Figure 10B:
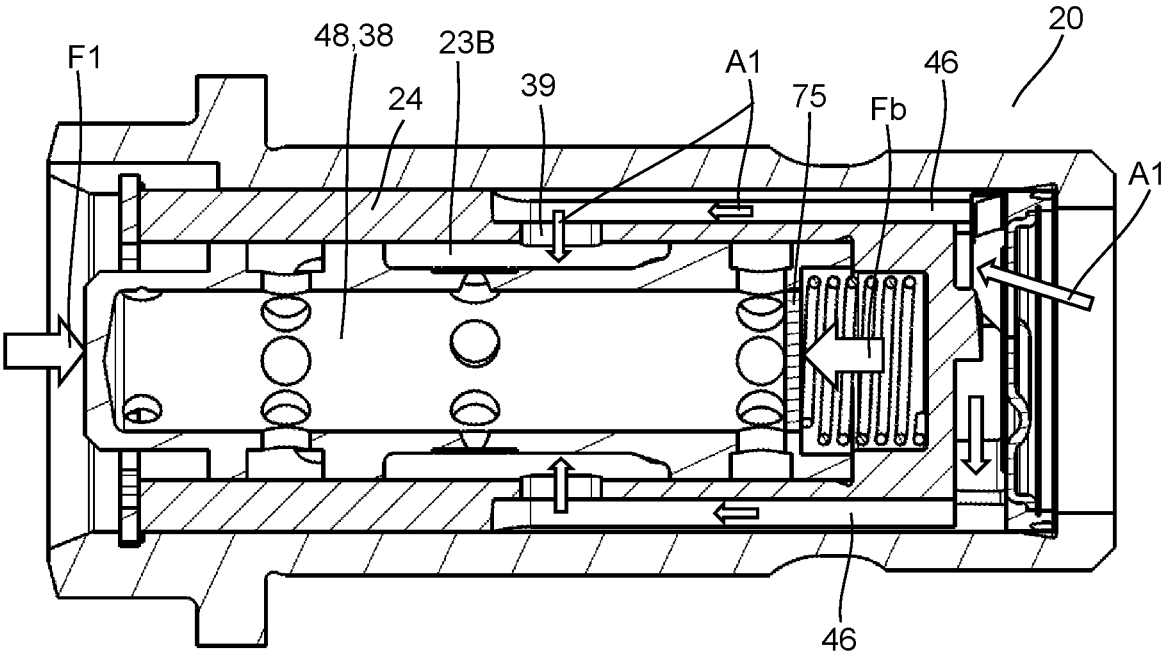
FIG. 10B is a cross-sectional view taken from FIG. 4 showing an inlet hydraulic fluid path in an energized state of the HFCV.
Figure 11A:
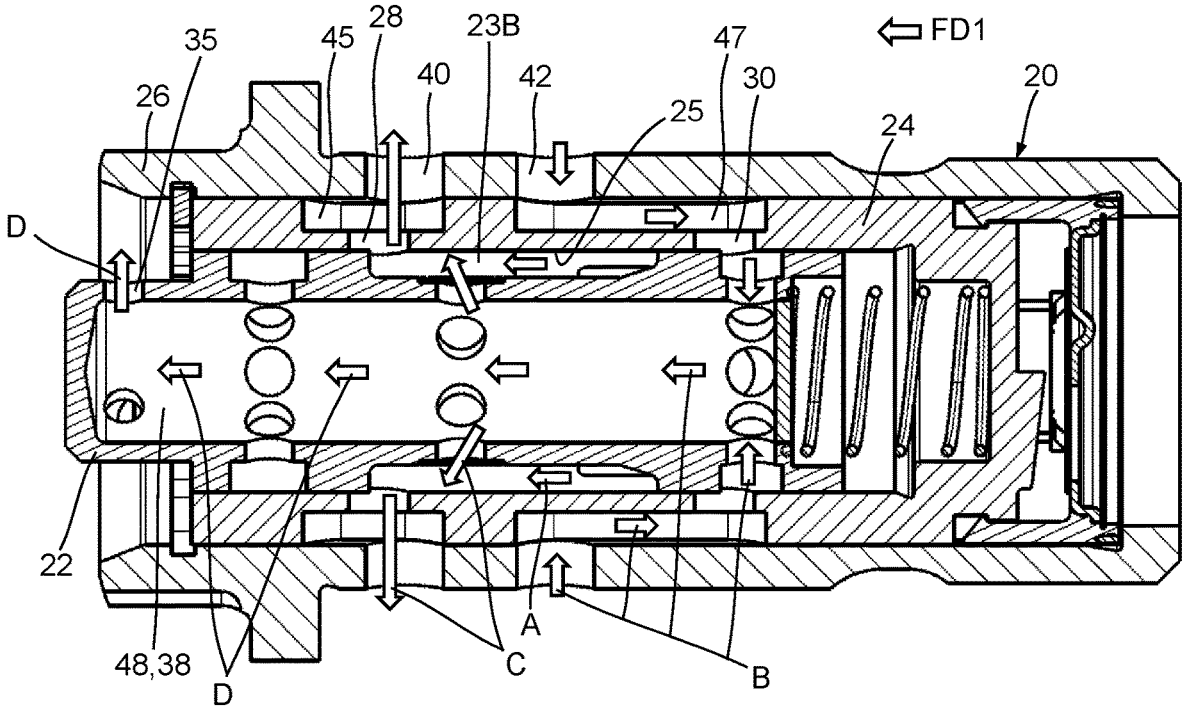
FIG. 11A is a cross-sectional view taken from FIG. 4 showing multiple hydraulic fluid paths in a de-energized state of the HFCV.
Figure 11B:
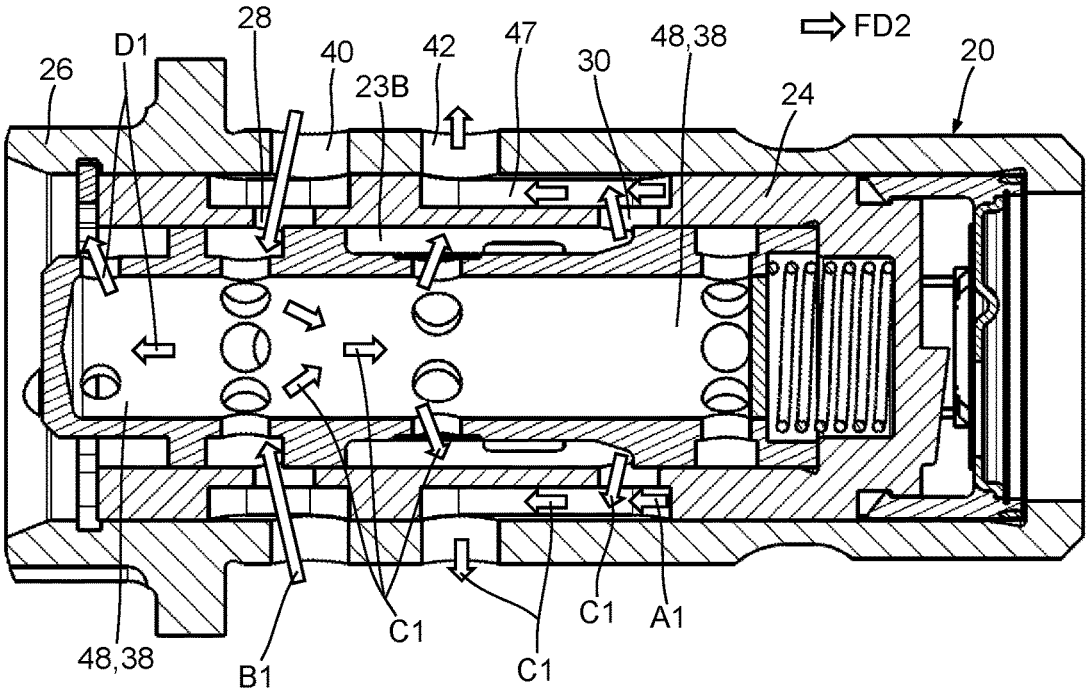
FIG. 11B is a cross-sectional view taken from FIG. 4 showing multiple hydraulic fluid paths in an energized state of the HFCV.

FIG. 1 is a perspective view of a camshaft phaser system 100 that includes an actuator 14 that actuates a hydraulic fluid control valve (HFCV) 20 of a camshaft phaser 10 that is attached to a camshaft 13. The actuator 14 is electronically controlled by an electronic controller (not shown), such as an engine control unit (ECU). FIG. 2 is a perspective view of the camshaft phaser 10 and HFCV 20 of FIG. 1. FIG. 3 is a perspective view of a rotor 11 and a stator 12 of the camshaft phaser 10 that shows hydraulic actuation chambers 43 formed between the rotor 11 and stator 12. FIG. 4 is a perspective view of the HFCV 20 of FIG. 1. FIG. 5 is an exploded perspective view of the HFCV 20 of FIG. 4, including a spool 22, a one-way valve 50, a hydraulic sleeve 24, and an outer housing 26. FIG. 6 is a perspective view of the one-way valve 50 of FIG. 5. FIG. 7 is a development view of the one-way valve 50 of FIG. 6. FIG. 8A is a perspective view of the spool 22 of FIG. 5 without the one-way valve 50 installed. FIG. 8B is a perspective view of the spool 22 of FIG. 5 with the one-way valve 50 installed. FIG. 9A is a perspective view of the hydraulic sleeve 24 of FIG. 5. FIG. 9B is an exploded perspective view of an example embodiment of a hydraulic sleeve 24A. FIG. 10A is a cross-sectional view taken from FIG. 4 that shows an inlet hydraulic fluid path in a de-energized state of the HFCV 20. FIG. 10B is a cross-sectional view taken from FIG. 4 that shows an inlet hydraulic fluid path in an energized state of the HFCV 20. FIG. 11A is a cross-sectional view taken from FIG. 4 showing multiple hydraulic fluid paths in a de-energized state of the HFCV 20. FIG. 11B is a cross-sectional view taken from FIG. 4 showing multiple hydraulic fluid paths in an energized state of the HFCV 20. The following discussion should be read in light of FIGS. 1 through 11B.

The camshaft phaser 10 is hydraulically actuated by pressurized hydraulic fluid F that is controlled by the HFCV 20 and actuator 14 to rotate the rotor 11 either clockwise CW or counterclockwise CCW about a rotational axis 16 relative to the stator 12 via hydraulic actuation chambers 43. As the rotor 11 is connected to the camshaft 13, clockwise CW and counterclockwise CCW rotation of the rotor 11 relative to the stator 12 can advance or retard an engine valve event with respect to a four-stroke cycle of an IC engine. Clockwise CW rotation of the rotor 11 relative to the stator 12 can be achieved by: 1). pressurization of first hydraulic actuation chambers 17A via a first hydraulic fluid gallery 44A arranged in the rotor 11; and, 2). de-pressurization of second hydraulic actuation chambers 17B via a second hydraulic fluid gallery 44B arranged in the rotor 11 that fluidly connects the second hydraulic actuation chambers 17B to tank via an exit through-aperture 35 arranged within the HFCV 20. Likewise, counterclockwise CCW rotation of the rotor 11 relative to the stator 12 can be achieved by: 1). pressurization of the second hydraulic actuation chambers 17B via the second hydraulic fluid gallery 44B arranged in the rotor 11; and, 2). de-pressurization of the first hydraulic actuation chambers 17A via the first hydraulic fluid gallery 44A that fluidly connects the first hydraulic actuation chambers 17A to tank via the exit through-aperture 35 arranged within the HFCV 20. The preceding pressurization and de-pressurization actions of the first and second hydraulic actuation chambers 17A, 17B can be accomplished by the HFCV 20. The HFCV 20 is fluidly connected to a hydraulic fluid pressure source 82 and is actuated by the actuator 14 which can communicate electronically with the ECU to control the camshaft phaser 10.

The HFCV 20 includes a housing 26, an inlet filter assembly 49, a hydraulic sleeve 24, a bias spring 15, a blocking disk 75, a one-way valve 50, a spool 22, and a retaining ring 80.

The spool 22 of the HFCV 20 is biased outward or towards the actuator 14 by the bias spring 15. The actuator 14 can have a pulse-width modulated solenoid that moves an armature toward the HFCV 20, applying a force F1 on an actuator end 37 of the spool 22 to overcome a biasing force Fb of the spring 15 to selectively move the spool 22 to a desired longitudinal position such as that shown in FIGS. 10B and 11B. Other forms of actuators to move the spool 22 are also possible. A position of the spool 22 within the HFCV 20 is controlled by the ECU which can control a duty cycle of the solenoid arranged within the actuator 14. The HFCV 20 could also be arranged outside of the camshaft phaser 10 at a remote location within the IC engine. The HFCV 20 could also have a solenoid integrated within the HFCV that functions to move the spool 22 instead of relying on a separate component, such as the actuator 14). The embodiments and functional strategies described herein can also apply to other HFCV arrangements not mentioned in this disclosure.

The HFCV 20 includes threads (not shown) arranged on the housing 26 that are received by threads (not shown) of the camshaft 13. The HFCV 20 axially clamps the rotor 11 to the camshaft 13, such that the rotor 11 and camshaft 13 are drivably connected.

Referring to FIGS. 11A and 11B, with view to FIG. 3, different longitudinal positions of the spool 22 are shown in which pressurized hydraulic fluid is delivered selectively to either first or second hydraulic actuation chambers 17A, 17B via: i) first and second fluid galleries 44A, 44B that are arranged within the rotor 11; and, ii) first and second fluid ports 40, 42 arranged on the housing 26 of the HFCV 20.

Clockwise CW actuation of the rotor 11 relative the stator 12 requires pressurization of the first hydraulic actuation chambers 17A via the first hydraulic fluid gallery 44A and de-pressurization of the second hydraulic actuation chambers 17B via the second hydraulic fluid gallery 44B. Camshaft torques, sometimes referred to as "torsionals", act on the camshaft in both clockwise and counterclockwise directions and are a result of valve train reaction forces that act on an opening flank and a closing flank of a camshaft lobe as it rotates. Assuming a clockwise rotating camshaft 13, an opening flank of a camshaft lobe can cause a counterclockwise CCW torque on the camshaft and camshaft phaser due to valve train reaction forces; furthermore, a closing flank of a camshaft lobe can cause a clockwise torque due to valve train reaction forces. In the case of a counterclockwise CCW torque, it is possible that this torque can overcome a force of a pressurized fluid F acting on a vane (or vanes) of the rotor 11 that is actuating the rotor 11 in a clockwise CW direction relative to the stator 12. In such an instance, hydraulic fluid F can be forced out of the first hydraulic actuation chambers 17A. The lobe of the camshaft 13 continues to rotate until it achieves its apex (peak lift) and then engagement of the closing flank of the lobe with the valve train causes a clockwise torque CW to act on the camshaft lobe. A counterclockwise torque CCW followed by a clockwise torque CW can induce a negative pressure in the first hydraulic actuation chambers 17A, requesting more oil to fill the first hydraulic actuation chambers 17A. This disclosure describes a recirculating HFCV in the following paragraphs, that can not only increase an HFCV's reactiveness to such torsionals and resultant negative pressures but can also reduce a camshaft phaser's pressurized hydraulic fluid consumption. This operating principle is achieved by routing some of the hydraulic fluid that is exiting one group of hydraulic actuation chambers to the other group of hydraulic actuation chambers for replenishment purposes.

The spool 22 includes, in successive order: a spring end 41, a first land 54, a second land 32, a third land 34, a fourth land 36, and an actuator end 37. The first and second lands 54, 32 form a first segment of the spool 22 that defines a first annular groove 23A; the second and third lands 32, 34 form a second segment that defines a second annular groove 23B; the third and fourth lands 34, 36 form a third segment that defines a third annular groove 23C; and the fourth land 36 and the actuator end 37 form a fourth segment that defines a head portion 18. The spool 22 further includes: at least one first through-aperture 29 arranged between the first and second lands 54, 32, within the first annular groove 23A; at least one second through-aperture 31 arranged between the second and third lands 32, 34, within the second annular groove 23B; at least one third through-aperture 33 arranged between the third and fourth lands 34, 36, within the third annular groove 23C; and, at least one exit or vent through-aperture 35 arranged between the fourth land 36 and an actuation end 37 of the spool 22 within the head portion 18. The spool 22 is closed at the actuation end 37 and open at the spring end 41. The spring end 41 abuts with or houses at least a portion of a bias spring 15.

The spool 22 has a longitudinal bore 48 having an inner radial surface 67, and, together with the blocking disk 75 disposed within the spring end 41 of the spool 22, forms an inner fluid chamber 38. Other arrangements of the spool 22 that do not include the blocking disk 75 are also possible. It could be stated that the inner fluid chamber 38 includes the first, second, third, and exit through-apertures 29, 31, 33, 35 such that the first, second, third, and exit through-apertures 29, 31, 33, 35 are fluidly connected to the inner fluid chamber 38. Furthermore, the first, second, third, and exit through-apertures 29, 31, 33, 35 can all be continuously fluidly connected to each other via the inner fluid chamber 38. That is, regardless of: a) the position of the spool, and b) whether the one-way valve 50 is open or closed, a continuous fluid connection between any one of the four through-apertures 29, 31, 33, 35 and any or all of the remaining three through-apertures can exist, as shown in the figures. For the discussion of this disclosure, two adjacent fluid galleries that are connected to each other via a one-way fluid valve are "fluidly connected" but not "continuously fluidly connected", as there are defined fluid pressure conditions that do not yield a flow of fluid from one hydraulic fluid gallery to the other.

For the discussion of this disclosure, the inner fluid chamber 38 is defined by a cavity, hollow or void that directly contacts and houses a volume of hydraulic fluid, particularly hydraulic fluid that is routed to or from the hydraulic actuation chambers 43. The inner fluid chamber 38 can be continuous without interruption (or continuously open), such that its entire length L directly contacts hydraulic fluid; stated otherwise, the inner fluid chamber 38 can be continuous from the first through-aperture 29 to the vent or exit through-aperture 35 so that hydraulic fluid can continuously flow and be housed within the inner fluid chamber 38 from the first through-aperture 29 to the exit through-aperture 35 without interruption. The inner fluid chamber 38 can be shaped as a bore, as shown in the figures, or any other suitable shape to receive and contact hydraulic fluid. As shown in the figures, additional components of the HFCV 20 are not installed or disposed within the inner fluid chamber 38, however, such an arrangement could be possible. As shown in FIG. 10A, a cross-sectional area of the inner fluid chamber 38 at any longitudinal position X within the length L of the inner fluid chamber 38 can be computed by multiplying a square of a radius Rx by pi (3.14159). The radius Rx extends from the rotational axis 16 of the HFCV 20 to the inner radial surface 67 of the bore 48 that defines the inner fluid chamber 38. The radius of the bore 48 shown in the figures is constant, however, the bore could have different radii throughout its length. Even so, the cross-sectional area of the inner fluid chamber 38 could still be defined by $((pi)\times Rx^2)$. In addition to being continuously open in a longitudinal direction from the first through-aperture 29 to the exit through-aperture 35, it could also be stated that the inner fluid chamber 38 is continuously open in a radial direction from the rotational axis 16 to the inner radial surface 67. A cutting plane that is arranged transversely to the rotational axis 16 and cuts through the inner fluid chamber 38 does not cut through any material (steel, plastic, etc.) from the inner radial surface 25 to the rotational axis 16. Therefore, the volume of the inner fluid chamber 38 can be determined by multiplying the cross-sectional area by the length L.

As shown in FIG. 7, the one-way valve 50 (or check-valve) can include a rectangular-shaped sheet 51 with a cut-away section 52 that is separated on three sides from the sheet 51. The one-way valve 50 is flexible so that it can be formed as a cylinder around a fourth annular groove 23D of the spool 22 which is located within the second annular groove (see FIGS. 6-8B), the fourth annular groove 23D including the second through-apertures 31. This is one of several possible locations that are possible for the one-way valve 50. The one-way valve 50: i) permits or provides hydraulic fluid flow from the inner fluid chamber 38 to the first hydraulic actuation chamber 17A or the second hydraulic actuation chamber 17B via the second through-apertures 31; and, ii) prevents hydraulic fluid flow from the first hydraulic actuation chamber 17A and the second hydraulic actuation chamber 17B to the inner fluid chamber 38. The one-way valve can be of any suitable design for the described function and does not have to be that which is described herein and shown in the figures.

The spool 22 is disposed at least partially in a bore 61 or hollow of the hydraulic sleeve 24. The hydraulic sleeve 24 is disposed in a bore 65 of the housing 26. The first, second, third, and fourth lands 54, 32, 34, 36 of the spool 22 engage and are slidably guided in a sealing manner by an inner surface 25 of the bore 61 of the hydraulic sleeve 24. In an embodiment without the hydraulic sleeve 24, the first, second, third, and fourth lands 54, 32, 34, 36 can slidably engage an inner surface 66 of a bore 65 of the housing 26. The hydraulic sleeve 24 has an open actuation end 21 and a closed fluid inlet end 27. The fluid inlet end 27 provides an abutment or housing for the bias spring 15 and a stop for the spring end 41 of the spool 22. The hydraulic sleeve includes inlet ports 39 arranged at the end of longitudinal cut-outs 46 of the hydraulic sleeve 24 that fluidly connect the spool 22 to the hydraulic fluid pressure source 82. First and second hydraulic actuation chamber ports 28, 30, via corresponding first and second cut-outs 45, 47, fluidly connect the respective first hydraulic actuation chamber 17A and the second hydraulic actuation chamber 17B to the HFCV 20.

FIG. 9B shows an example embodiment of a hydraulic sleeve 24A that includes a base tube 62 and an injection-molded casing 64 that is formed around the base tube 62. The injection-molded casing 64 can simplify the manufacturing process required to achieve the previously described fluid cut-outs and other features, as needed. Other suitable shapes of the base tube 62 and injection-molded casing 64 are possible.

FIG. 10A shows a cross-sectional view of the HFCV 20 that cuts through the longitudinal cut-outs 46 of the hydraulic sleeve to clearly show a hydraulic fluid path A of the HFCV 20 when the spool 22 is in its first position (de-energized position). In this first position of the spool 22, hydraulic fluid moves through the inlet filter assembly 49 before it enters the hydraulic sleeve 24. Referring to FIG. 5, the inlet filter assembly 49 includes a housing 74, an inlet filter 70, and a one-way valve 72. The inlet filter assembly is engaged with the hydraulic sleeve 24 via tabs 76 of the housing 74 that are received by tab landings 78 arranged on the hydraulic sleeve 24. The one-way valve 72 provides hydraulic fluid flow from the hydraulic fluid pressure source 82 to the HFCV 20, but not vice-versa. The hydraulic fluid moves through the open one-way valve 72, into the longitudinal cut-outs 46 of the hydraulic sleeve 24, through the inlet ports 39 of the hydraulic sleeve, and into the second annular groove 23B of the spool 22. From the second annular groove 23B, the hydraulic fluid continues to flow until it reaches the first hydraulic actuation chamber 17A as will now be explained.

FIG. 11A shows a cross-sectional view of the HFCV 20 that cuts through the fluid ports 40, 42 of the housing 26 while the spool 22 is in its first position to clearly show additional hydraulic paths B, C, D. The first position of the spool 22 facilitates: i) delivery of pressurized hydraulic fluid to the first hydraulic actuation chambers 17A via the first hydraulic actuation ports 28 and the first fluid ports 40; and, ii) an exit hydraulic fluid path B from the second hydraulic actuation chambers 17B to the inner fluid chamber 38 via the second fluid ports 42 and the second hydraulic actuation ports 30. Once in the inner fluid chamber 38, hydraulic fluid travels from the spring end 41 towards the actuation end 37 in a first fluid flow direction FD1. A negative hydraulic fluid pressure condition, or any need for hydraulic fluid within the first hydraulic actuation chambers 17A, can be accommodated by the exiting hydraulic fluid from the second hydraulic actuation chambers 17B via the second hydraulic actuation ports 30. The exiting hydraulic fluid from the second hydraulic actuation chambers 17B can flow via hydraulic fluid path B to and within the inner fluid chamber 38 until it splits into two hydraulic fluid paths C, D. Hydraulic fluid path C, extending radially outward from hydraulic path B, can facilitate hydraulic fluid flow to the first hydraulic actuation port 28 via the one-way valve 50. The one-way valve 50 opens radially towards and can be limited in its travel by the radial inner surface 25 of the hydraulic sleeve 24. Hydraulic fluid path D can facilitate hydraulic fluid flow from the inner fluid chamber 38 to the sump (or tank) via the exit or vent through-aperture 35.

FIG. 10B shows a cross-sectional view of the HFCV 20 that cuts through the longitudinal cut-outs 46 of the hydraulic sleeve to clearly show a hydraulic fluid path A1 of the HFCV 20 when the spool 22 is selectively moved to its second position by the actuator 14 (energized position). In this second position of the spool 22, hydraulic fluid moves through the inlet filter assembly 49 before it enters the hydraulic sleeve 24. The hydraulic fluid moves through the open one-way valve 72, into the longitudinal cut-outs 46 of the hydraulic sleeve 24, through the inlet ports 39 of the hydraulic sleeve, and into the second annular groove 23B of the spool 22. From the second annular groove 23B, the hydraulic fluid continues to flow until it reaches the second hydraulic actuation chambers 17B as will now be explained.

FIG. 11B shows a cross-sectional view of the HFCV 20 that cuts through the fluid ports 40, 42 of the housing 26 while the spool 22 is in its second position to clearly show hydraulic fluid flow paths B1, C1, D1. The second position of the spool 22 facilitates: i) delivery of pressurized hydraulic fluid to the second hydraulic actuation chambers 17B via the second hydraulic actuation ports 30 and the second fluid ports 42; and, ii) an exit hydraulic fluid flow path B1 from the first hydraulic actuation chambers 17A to the inner fluid chamber 38 via the first fluid ports 40 and the first hydraulic actuation ports 28. A negative hydraulic fluid pressure condition, or any need for hydraulic fluid within the second hydraulic actuation chambers 17B, can be accommodated by the exiting hydraulic fluid from the first hydraulic actuation chambers 17A via the first hydraulic actuation port 28. The exiting hydraulic fluid from the first hydraulic actuation chambers 17A can flow via hydraulic fluid path B1 to and into the inner fluid chamber 38 and split into two hydraulic fluid paths C1, D1. Hydraulic fluid path C1, can facilitate hydraulic fluid flow to the second hydraulic actuation ports 30 via the one-way valve 50. Hydraulic fluid moves in a second fluid flow direction FD2, opposite the first flow direction FD1, within the inner fluid chamber 38 via hydraulic path C1 to exit the inner fluid chamber 38 via the one-way valve 50. The one-way valve 50 opens towards and can be limited in its travel by the inner radial surface 25 of the hydraulic sleeve 24. Hydraulic fluid path D1 can facilitate hydraulic fluid flow from the inner fluid chamber 38 to the sump (or tank) via the vent through-aperture 35.

In the first spool position shown in FIG. 11A, the HFCV 20 recirculates exiting oil from the second hydraulic actuation chambers 17B to the first hydraulic actuation chambers 17A. This is accomplished by fluidly connecting the second hydraulic actuation chambers 17B to the first hydraulic actuation chambers 17A via, in successive order, the second fluid ports 42 of the housing 26, the second fluid cut-out 47 of the hydraulic sleeve 24, the second hydraulic actuation ports 30 of the hydraulic sleeve 24, the first annular groove 23A of the spool 22, the first through-apertures 29 of the spool 22, the inner fluid chamber 38 of the spool 22, the second through-apertures 31 of the spool 22, the one-way valve 50, the second annular groove 23B of the spool 22, the first hydraulic actuation ports 28 of the hydraulic sleeve 24, the first fluid cut-outs 45 of the hydraulic sleeve 24, and the first fluid ports 40 of the housing 26. Given the previously described function of the second through-apertures 31, they can also be referred to as recirculation apertures.

In the second spool position shown in FIG. 11B, the HFCV 20 recirculates oil from the first hydraulic actuation chambers 17A to the second hydraulic actuation chambers 17B. This is accomplished by fluidly connecting the first hydraulic actuation chambers 17A to the second hydraulic actuation chambers 17B via, in successive order, the first fluid ports 40 of the housing 26, the first fluid cut-outs 45 of the hydraulic sleeve 24, the first hydraulic actuation ports 28 of the hydraulic sleeve 24, the third annular groove 23C of the spool 22, the third through-apertures 33 of the spool 22, the inner fluid chamber 38 of the spool 22, the second through-apertures 31 of the spool 22, the one-way valve 50, the second annular groove 23B of the spool 22, the second hydraulic actuation ports 30 of the hydraulic sleeve 24, the second fluid cut-outs 47 of the hydraulic sleeve 24, and the second fluid ports 42 of the housing 26.

FIGS. 11A and 11B show respective recirculation flow paths to provide hydraulic fluid replenishment for one of the first or second hydraulic actuation chambers 17A, 17B. In such instances of hydraulic fluid replenishment, a portion of an incoming flow to the inner fluid chamber 38 via hydraulic flow paths B and B1 can be routed or delivered to the pressurized fluid-starved hydraulic actuation chamber. For example, in the first position of the spool shown in FIG. 11A, the first hydraulic actuation chambers 17A, via the first fluid ports 40, are replenished with hydraulic fluid from hydraulic paths C and A. Likewise, in the second position of the spool shown in FIG. 11B, the second hydraulic actuation chambers 17B, via the second fluid ports 42, are replenished with hydraulic fluid from hydraulic paths C1 and A1. In instances where neither of the first or second hydraulic actuation chambers 17A, 17B require or need replenishment in the respective first and second positions of the spool 22, respective fluid flow paths C and C1 will not be utilized, and no portion of the incoming flow to the inner fluid chamber 38 will be re-used; instead, respective fluid flow paths D and D1 will exit all of the incoming hydraulic fluid flowing into the inner fluid chamber 38 via flow paths B and B1.

The size or diameter of the vent through-aperture 35 can be adjusted to tune the amount of recirculation that occurs within the HFCV 20. This amount could be dependent upon the magnitude of the camshaft torsionals acting on the camshaft phaser; for example, higher camshaft torsionals may require a smaller sized vent through-aperture. In some applications, the vent through-aperture 35 could even be eliminated so that the inner fluid chamber serves to exclusively facilitate recirculation without directing any fluid to tank (other than that which escapes to tank via internal leakage of the HFCV).

The flow paths B-D, B1-D1 shown in FIGS. 10A, 10B, 11A, 11B can each have multiple instances such that they are symmetrically arranged relative to a circumference of the cylinder sleeve. In the example embodiment shown in the figures, a transverse cutting plane that intersects the rotational axis 16 of the HFCV 20 and one of the flow paths also intersects a second instance of the same flow path. Other arrangements of flow paths are also possible, including non-symmetrical arrangements.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A hydraulic fluid control valve, comprising:

a housing having:

a first fluid port configured to be fluidly connected to a first hydraulic actuation chamber; and, a second fluid port configured to be fluidly connected to a second hydraulic actuation chamber, the first hydraulic actuation chamber and the second hydraulic actuation chamber configured to receive and exit hydraulic fluid; and, a spool disposed at least partially within the housing, the spool having:

a vent aperture;

a first aperture;

a second aperture; and, a third aperture; and, the first aperture, the second aperture, and the third aperture are configured to move in unison; and, each of the first aperture, the second aperture, and the third aperture are continuously fluidly connected to each other; and, in a first axial position of the spool:

the first aperture is configured to receive hydraulic fluid from the first hydraulic actuation chamber;

the second aperture is configured to deliver a first portion of the hydraulic fluid from the first hydraulic actuation chamber to the second hydraulic actuation chamber; and, the vent aperture is configured to exit a second portion of the hydraulic fluid from the first hydraulic actuation chamber; and, in a second axial position of the spool:

the third aperture is configured to receive hydraulic fluid from the second hydraulic actuation chamber;

the second aperture is configured to deliver a first portion of the hydraulic fluid from the second hydraulic actuation chamber to the first hydraulic actuation chamber; and, the vent aperture is configured to exit a second portion of the hydraulic fluid from the second hydraulic actuation chamber.

2. The hydraulic fluid control valve of claim 1, wherein the first aperture is arranged at a spring end of the spool, the vent aperture is arranged at an actuation end of the spool, and the second aperture and the third aperture are arranged between the first aperture and the vent aperture.

3. The hydraulic fluid control valve of claim 2, wherein the spool further comprises a longitudinally extending inner fluid chamber configured to: i) directly contact hydraulic fluid, and ii) continuously fluidly connect each of the vent aperture, the first aperture, the second aperture, and the third aperture to each other in the first and second axial positions of the spool.

4. The hydraulic fluid control valve of claim 1, further comprising a one-way valve, the one-way valve arranged between: i) the first and the second apertures in a longitudinal direction of the spool, and ii) a radial outer surface of the spool and a radial inner surface of the housing.

5. The hydraulic fluid control valve of claim 4, wherein the one-way valve is configured to allow: i) the hydraulic fluid from the first hydraulic actuation chamber to flow from the second aperture to the second hydraulic actuation chamber in the first axial position of the spool; and, ii) the hydraulic fluid from the second hydraulic actuation chamber to flow from the second aperture to the first hydraulic actuation chamber in the second axial position of the spool.

6. The hydraulic fluid control valve of claim 4, wherein the one-way valve opens in a radial direction.

7. A hydraulic fluid control valve, comprising:

a housing having a first fluid port and a second fluid port, the first fluid port configured to be fluidly connected to a first hydraulic actuation chamber, the second fluid port configured to be fluidly connected to a second hydraulic actuation chamber, and the first hydraulic actuation chamber and the second hydraulic actuation chamber configured to receive and exit hydraulic fluid; and, a spool disposed at least partially within the housing, the spool having an inner fluid chamber configured to directly contact hydraulic fluid, the inner fluid chamber including:

a first aperture;

a second aperture; and, a third aperture; and the inner fluid chamber configured to: i) continuously fluidly connect each of the first aperture, the second aperture, and the third aperture to each other; ii) receive hydraulic fluid from the first hydraulic actuation chamber and deliver a first portion of the hydraulic fluid from the first hydraulic actuation chamber to the second hydraulic actuation chamber when the spool is in a first axial position; and, iii) receive hydraulic fluid from the second hydraulic actuation chamber and deliver a first portion of the hydraulic fluid from the second hydraulic actuation chamber to the first hydraulic actuation chamber when the spool is in a second axial position; and, a one-way valve configured to: i) allow hydraulic fluid from the first hydraulic actuation chamber or hydraulic fluid from the second hydraulic actuation chamber to flow from the inner fluid chamber to the respective second hydraulic actuation chamber and the first hydraulic actuation chamber, and ii) prevent hydraulic fluid flow into the inner fluid chamber when the spool is in the first axial position and the second axial position.

8. The hydraulic fluid control valve of claim 7, further comprising a vent aperture configured to exit a second portion of the hydraulic fluid from the first hydraulic actuation chamber and a second portion of the hydraulic fluid from the second hydraulic actuation chamber, and the inner fluid chamber is configured to continuously fluidly connect each of the first aperture, the second aperture, the third aperture, and the vent aperture to each other.

9. The hydraulic fluid control valve of claim 8, wherein the vent aperture is arranged at an actuation end of the spool.

10. The hydraulic fluid control valve of claim 7, wherein the second aperture is configured to: i) deliver the first portion of the hydraulic fluid from the first hydraulic actuation chamber to the second hydraulic actuation chamber; and, ii) deliver the first portion of the hydraulic fluid from the second hydraulic actuation chamber to the first hydraulic actuation chamber.

11. The hydraulic fluid control valve of claim 10, wherein the one-way valve is arranged between a radial outer surface of the spool and a radial inner surface of the housing.

12. The hydraulic fluid control valve of claim 11, wherein the one-way valve opens in a radial direction.

* * * * *